US008496250B2

(12) United States Patent
Schugar et al.

(10) Patent No.: US 8,496,250 B2
(45) Date of Patent: Jul. 30, 2013

(54) METHOD FOR ADJUSTING A RANDOM NUMBER GENERATOR USED FOR WAGERING BY ADJUSTING PAYOUTS OR USING LIQUID FUNDS

(76) Inventors: David Schugar, Crown Point, IN (US); Gregg Solomon, Las Vegas, NV (US)

( * ) Notice: Subject to any disclaimer, the term of this patent is extended or adjusted under 35 U.S.C. 154(b) by 0 days.

(21) Appl. No.: 13/118,453

(22) Filed: May 30, 2011

(65) Prior Publication Data

US 2012/0004019 A1 Jan. 5, 2012

Related U.S. Application Data

(60) Division of application No. 11/379,561, filed on Apr. 20, 2006, now Pat. No. 7,950,995, and a continuation-in-part of application No. 11/379,555, filed on Apr. 20, 2006, now Pat. No. 7,976,381, which is a continuation-in-part of application No. 11/158,919, filed on Jun. 22, 2005, now Pat. No. 7,909,694, which is a continuation-in-part of application No. 10/754,587, filed on Jan. 12, 2004, now Pat. No. 8,096,865, which is a continuation-in-part of application No. 10/410,448, filed on Apr. 10, 2003, now Pat. No. 7,294,054, application No. 11/379,555, which is a continuation-in-part of application No. 10/874,558, filed on Jun. 24, 2004, now Pat. No. 7,354,343, and a continuation-in-part of application No. 10/688,898, filed on Oct. 21, 2003, now Pat. No. 7,163,458.

(60) Provisional application No. 60/726,628, filed on Oct. 13, 2005, provisional application No. 60/745,263, filed on Apr. 20, 2006, provisional application No. 60/548,481, filed on Feb. 26, 2004.

(51) Int. Cl.
*A63F 9/00* (2006.01)

(52) U.S. Cl.
USPC ..... 273/292

(58) Field of Classification Search
USPC ..... 273/292
See application file for complete search history.

(56) References Cited

U.S. PATENT DOCUMENTS

| | | | | |
|---|---|---|---|---|
| 6,520,856 | B1 * | 2/2003 | Walker et al. | 463/21 |
| 2003/0119579 | A1 * | 6/2003 | Walker et al. | 463/20 |
| 2005/0085290 | A1 * | 4/2005 | Schugar | 463/22 |

* cited by examiner

*Primary Examiner* — Michael Dennis
(74) *Attorney, Agent, or Firm* — Muskin & Cusick LLC

(57) ABSTRACT

A method, apparatus, and computer readable storage to implement a wagering game which uses a random number generator to affect outcomes. The random number generator can be weighted by the player in exchange for a change in payouts. The random number generator can also be weighted in exchange for a cash purchase from the player or a cash payment to the player.

14 Claims, 6 Drawing Sheets

METHOD FOR ADJUSTING A RANDOM NUMBER GENERATOR USED FOR WAGERING BY ADJUSTING PAYOUTS OR USING LIQUID FUNDS

CROSS REFERENCE TO RELATED APPLICATIONS

This application is a divisional application of application Ser. No. 11/379,561 which claims benefit to provisional application No. 60/726,628, which is incorporated by reference herein in its entirety. This application is a divisional application of application Ser. No. 11/379,561, which claims benefit to provisional application No. 60/745,263, filed on Apr. 20, 2006, which is incorporated by reference herein in its entirety. This application is a divisional application of application Ser. No. 11/379,561, which is a continuation in part of application Ser. No. 11/379,555, filed on Apr. 20, 2006, which is incorporated by reference herein in its entirety and is: 1) a continuation in part of application Ser. No. 11/158,919, filed on Jun. 22, 2005, entitled, "Wagering Game With Player Banking of Positive Expectation Situations," which is a continuation in part of application Ser. No. 10/754,587, filed on Jan. 12, 2004, entitled, "Casino Games Directed to Betting on Progressions," which is a continuation in part of application Ser. No. 10/410,448, filed on Apr. 10, 2003, entitled, "Wagering Method, Device, and Computer Readable Storage Medium, for Wagering on Pieces in a Progression," all three of which are incorporated by reference herein in their entireties for all purposes; and 2) is also a continuation in part of application Ser. No. 10/874,558, filed on Jun. 24, 2004, entitled, "Wagering Game Where Player Can Borrow Money for Wagers Based on Equity Position" which is incorporated by reference in its entirety for all purposes and a) derives claims benefit from the provisional patent application entitled, "Wagering Game Where Player Can Borrow Money Based on Positive Expectation," filed on Feb. 26, 2004, Ser. No. 60/548,481, which is incorporated by reference herein in its entirety for all purposes and b) is also Continuation in Part (CIP) of patent application Ser. No. 10/688,898, filed on Oct. 21, 2003, entitled, "A Casino Game for Betting on a Bidirectional Linear Progression," which is incorporated by reference herein in its entirety for all purposes. All applications referenced by their serial number above are incorporated by reference in their entireties for all purposes and all features can be combined without limitation.

BACKGROUND OF THE INVENTION

1. Field of the Invention

The present invention is directed to a method, apparatus, and computer readable storage for implementing a wagering game which allows a player to adjust a random number generator and/or payouts on the game.

2. Description of the Related Art

Wagering games come in all shapes and sizes. Casinos are always looking for additional wagering games in order to provide a more exciting game for the player as well as ways to generate more revenue for the casino.

SUMMARY OF THE INVENTION

It is an aspect of the present invention to provide a wagering game which can be exciting to players.

The above aspects can be obtained by a method that includes (a) receiving a wager from a player in a first game state with a payout; (b) determining an adjusted random number generator; and (c) computing an adjusted payout for the wager using the adjusted random number generator.

The above aspects can also be obtained by a method that includes (a) receiving a wager from a player in a first game state with a payout; (b) determining an adjusted random number generator; and (c) computing a cost to the player to use the adjusted random number generator.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
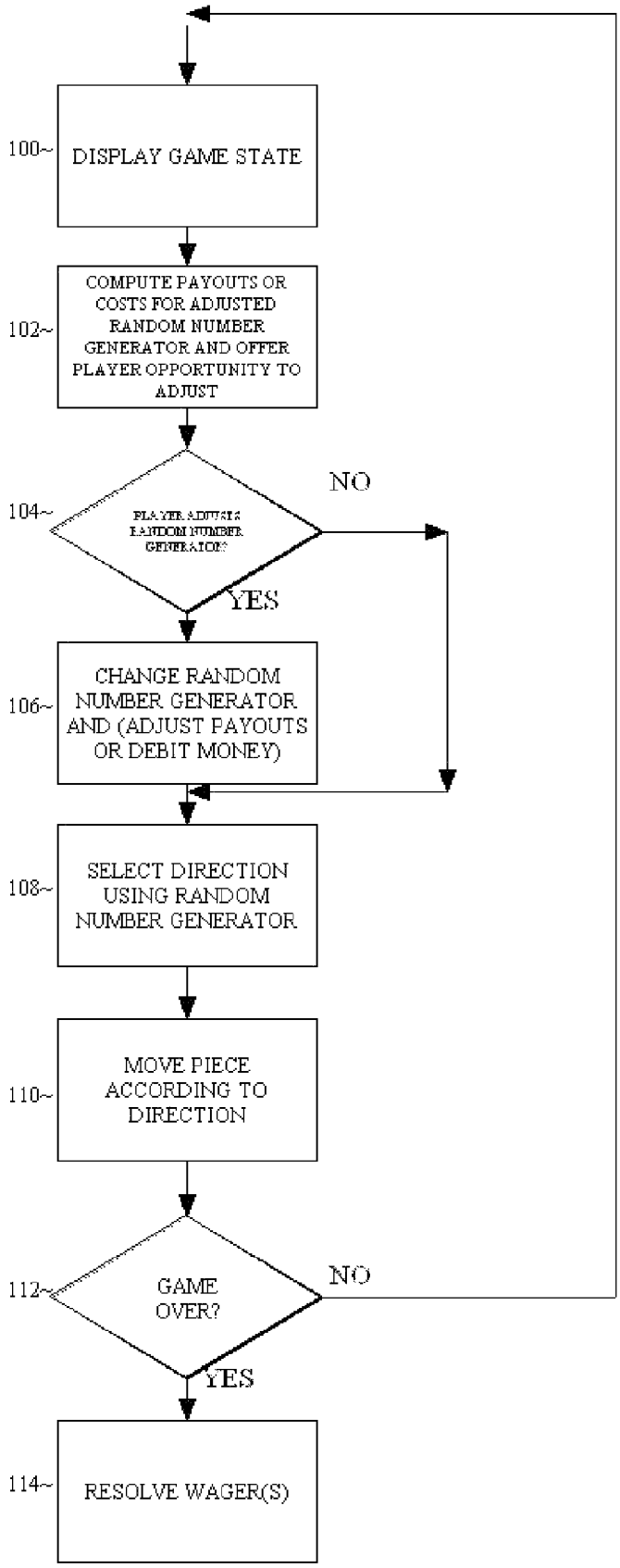
FIG. 1 is a flowchart illustrating an exemplary method of adjust a random number generator, according to an embodiment.

Reference will now be made in detail to the presently preferred embodiments of the invention, examples of which are illustrated in the accompanying drawings, wherein like reference numerals refer to like elements throughout.

The present general inventive concept relates to a method, system, and computer readable storage to implement a wagering game. More particularly, a wagering game, such as a bidirectional linear progression, can be improved upon by allowing adjustment of the random number generator. Previously discussed in the documents incorporated by reference is a bidirectional linear progression game in which a random number generator is used to determine a direction of a piece (s). The random number generator can have equal weights, thus it is equally likely to move the piece on one direction or the other.

The random number generator can also be adjusted. An adjusted random number generator is one such that outcomes (either on the RNG itself or a resultant action) can be weighted and may not have an equal distribution. For example, if a RNG is to pick a number between 1 and 10, it can be weighted towards a number (e.g. 2), such that there would be more 2's than an equal distribution. An adjusted RNG can be part of a game which can be used to affect outcomes and prefer certain outcomes or actions based on the RNG. Thus, in this type of adjusted RNG, for example, sides of a die may still have an equal chance of occurring, but actions associated with the sides may occur more frequently. For example, if a six sided die has four sides marked lose and 2 sides marked win, the die can be considered an adjusted RNG with a preferred outcome (lose). Another way to look at an adjusted RNG is that its distribution (results or associated actions) is modified from a prior RNG, thus it is "adjusted." Adjusting an RNG with bets already placed can affect the expected values of those bets.

The random number generator can allow the player to weigh the result of the random number generator. For example, the random number generator can be more likely to cause a piece to move to a particular side or direction. For example, in a bidirectional linear progression game, a six sided die can be used, with three sides which are marked "left" and will move a piece left, and three sides which are marked "right" and can move a piece right. With a 3/3 split, the piece has an equal chance of moving left or right. If the die were weighted, such that there were 4 sides marked left and 2 sides marked right, then the piece would of course have a greater chance of moving left. To skew the random number generator in this matter would have an interesting affect on the payouts, since it will make some propositions (e.g. reaching either side) more or less likely. Thus, payouts can change, depending on the affect of changes to the random number generator. Alternatively (or additionally), a player can buy (or sell) changes to the random number generator. For example, if a change to the random number generator results in a piece being more likely to result in a win for a player, the change can cost the player some money. Alternatively, if a change to the random number generator will result in a player more likely to lose, the player may be compensated with cash (or other compensation) for the change in the random number generator.

FIG. 1 is a flowchart illustrating an exemplary method of adjusting a random number generator, according to an embodiment.

The method starts with operation 100, which displays a current game state. If this is the initial time at this operation, then the game state can be initialized (e.g. setting the pieces to their initial position(s), etc.)

From operation 100, the method can proceed to operation 102, which computes payouts for an adjusted random number generator and offers the player an opportunity to adjust the random number generator. Alternatively, the payouts can be computed upon a player inquiry of an adjustment of the random number generator. Depending on the current state of the game, an adjustment may increase or decrease the payouts. More on computing costs for adjusting the random number generator (RNG) will be discussed below in more detail.

From operation 102, the method can proceed to operation 104, which determines whether the player has decided to adjust the RNG. The player can indicate his or her desire to adjust the RNG by using a player input device such as a mouse, touch-screen, etc. If the determination determines that the player has not adjusted the RNG, then the method can proceed to operation 108 which can continue the game as normal.

If the determination determines that the player has adjusted the RNG, then the method can proceed to operation 106, which adjusts the RNG and adjusts payouts or debits or credits money. This operation will be described below in more detail.

From operation 106, the method can proceed to operation 108, which activates the random number generator (whether adjusted or not) to generate a number and thereby select a direction to move a piece.

From operation 108, the method can proceed to operation 110, which moves the piece based on the direction determined in operation 106.

From operation 110, the method proceeds to operation 112, which determines whether the game is over. The game can be over if a condition which would end the game has occurred, for example if the piece has reached a particular area(s). If the game is not over, then the method can return to operation 110, which displays a successive game state with the piece(s) moved in operation 108. The method can then proceed.

If the determination in operation 112 determines that the game is over, then the method proceeds to operation 114, which resolves the wager. Any losing wagers are taken, and any winning wagers are paid, according to respective odds for the wager(s).

Figure 2A:
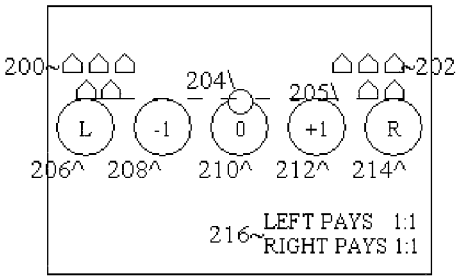
FIG. 2A is an example screen output of a first state of a wagering game allowing adjustment of payouts, according to an embodiment.

A table of probabilities can be generated for each of the positions on a bidirectional linear progression game. This particular game uses a playing field such as illustrated in FIG. 2A, although tables for other game conditions can of course be developed as well (e.g. any other number of positions for the piece, etc.) The table gives the probability of each side winning for each position on the field and the weight of the RNG. For example, if the piece is in the 0 position, and the RNG is weighted 5 left/5 right (even), then the probability of the piece reaching either side is 50%. If the piece is in the 0 position, and the RNG is weight 6 left/4 right, then the probability of the piece reaching the left side is 70% and the probability of the piece reaching the right side is 30%. Note that in this example, the RNG can be thought of as a 10-sided die, with the respective number of sides designated as "left" and "right." For example, in the latter example (6 left/4 right), the die has 6 left sides and 4 right sides. The probabilities from Table I can be used to determine proper payouts for adjusted RNG's. A table such as Table I can be generated by programming a random simulation of the game and tabulating the results, as well known in the art. Note that the numbers in Table I are rounded and may not be precise and are used for exemplary purposes only.

TABLE I

| position | left | right | prob left | prob right |
|---|---|---|---|---|
| −1 | 9 | 1 | 99.3% | .07% |
| −1 | 8 | 2 | 99% | 01% |
| −1 | 7 | 3 | 95% | 05% |
| −1 | 6 | 4 | 87% | 13% |
| −1 | 5 | 5 | 76% | 24% |
| −1 | 4 | 6 | 58% | 42% |
| −1 | 3 | 7 | 41% | 59% |
| −1 | 2 | 8 | 25% | 75% |
| −1 | 1 | 9 | 11% | 89% |
| 0 | 9 | 1 | 99% | 01% |
| 0 | 8 | 2 | 95% | 05% |
| 0 | 7 | 3 | 85% | 15% |
| 0 | 6 | 4 | 70% | 30% |
| 0 | 5 | 5 | 50% | 50% |
| 0 | 4 | 6 | 30% | 70% |
| 0 | 3 | 7 | 15% | 85% |
| 0 | 2 | 8 | 5% | 95% |
| 0 | 1 | 9 | 1% | 99% |
| +1 | 9 | 1 | 89% | 11% |
| +1 | 8 | 2 | 75% | 25% |
| +1 | 7 | 3 | 59% | 41% |
| +1 | 6 | 4 | 42% | 58% |
| +1 | 5 | 5 | 24% | 76% |
| +1 | 4 | 6 | 13% | 87% |
| +1 | 3 | 7 | 5% | 95% |
| +1 | 2 | 8 | 1% | 99% |
| +1 | 1 | 9 | .07% | 99.93% |

An illustrative run of a game implementing features described with respect to FIG. 1 will now be presented. Of course, this run is merely an example, and an almost infinite number of other game rules and game situations can be generated. One game used to illustrate principles described herein is the bidirectional linear progression game, although of course any other games that can use a random number generator to change states can be used as well.

FIG. 2A is an example screen output of a first state of a wagering game allowing adjustment of payouts, according to an embodiment.

The game has positions L position 206, −1 position 208, 0 position 210, +1 position 212, and R position 214. The game begins in the initial state, wherein a puck (or piece) 204 is in the 0 position 210. A left weight area 200 displays a magnitude of the left side weight. A right weight area 202 displays a magnitude of the right side weight. An optional rope 205 is illustrated as a dotted line and is used to convey a sense of "tug of war" between the left side and the right side. A payout indicator 216 indicates payouts if a bet were currently placed in the displayed game state on each side (left or right). When the piece 204 reaches the L position 206 or the R position 214 the game has ended and wagers will be paid/taken depending on whether the correct side was chosen or not.

Not pictured is an output of a player's bankroll and the player's current live wagers.

In the current game state, the RNG is equally weighted for the left side and the right side (e.g. an equal number of weights for each).

The first state is now progressed to a second state (e.g. by a pressing of a button or automatically).

Figure 2B:
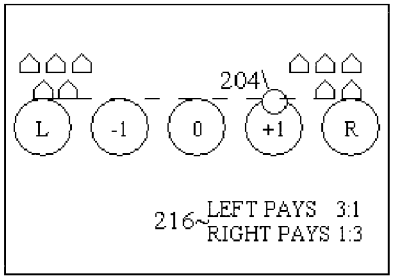
FIG. 2B is an example screen output of a second state of a wagering game allowing adjustment of payouts, according to an embodiment.

FIG. 2B is an example screen output of a second state of a wagering game allowing adjustment of payouts, according to an embodiment.

The RNG (not pictured) has resulted in a move of "right," and thus the piece 204 now moves to the right to the +1 position 212. The payout indicator 216 indicates that a bet on the left side now pays 3:1 and a bet on the right side now pays 1:3. This is because since the puck has moved to the right, it is of course more likely for the puck to now reach the R position 214 versus the L position 206, each of which would end the game.

The payouts displayed in the payout indicator 216 can be computed as follows. Using Table I, with the piece 204 in the +1 position 212, the probability of the piece 204 reaching the left side is 24%. Assuming for simplicity a $1 bet is placed on the left side, then $1/0.24=4.167. Subtracting one from 4.167=3.167. Thus a payout (without a house advantage, subject to rounding) for the piece 204 to reach the left side would be 3.167 to 1, or 3:1 if rounded to a whole number. This also gives the house a small advantage, since the payout is slightly less than the true-odds payout. A payout for the right side can be computed similarly, wherein the probability for the piece 204 in the +1 position 212 to reach the right side is 76%, thus (1/0.76)−1=0.315:1 or 1:0.315, or rounded to 1:3.

Note that the player can have the option to adjust the RNG by weighting it to either side. The player can do this, for example by clicking the weights on either side to add weights to the clicked side (which may or may not cause a weight on the opposite side to disappear).

In this example, in the second state, the player adds a weight to the right side (which can result in a weight from the left side being automatically moved or removed). Thus, the player decides to have six weights on the right side and four weights on the left. This results in the third state.

Figure 2C:
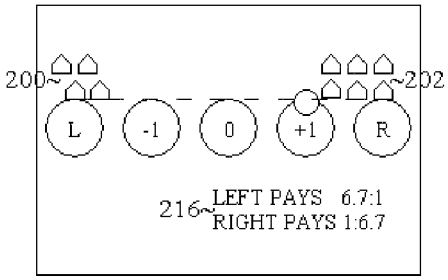
FIG. 2C is an example screen output of a third state of a wagering game allowing adjustment of payouts from an adjusted RNG, according to an embodiment.

FIG. 2C is an example screen output of a third state of a wagering game allowing adjustment of payouts, according to an embodiment.

In the third state, the player has added a weight to the right side and removed a weight from the left side. Thus, the puck is more likely to now move to the right with this adjusted RNG. For example, consider the RNG to be a 10 sided die with 6 "right" sides and 4 "left" sides.

Note that the payout indicator 216 indicates that a bet on the left side pays 6.7:1 and a bet on the right side pays 1:6.7. This is intuitive in that the piece 204 is much more likely to reach the right side than the left side, which is why a wager on the left side pays much more. The piece 204 is more likely to reach the right side for two reasons: it is closer to the R position 214, and the RNG is weighted more towards the right side.

The payouts can be determined as follows. When the piece 204 is on the +1 position 205, with a 4/6 RNG, from Table I we see that the chances of the piece 204 reaching the left side is 13%. (1/0.13)−1=6.69 or rounded to 6.7. Thus, a possible payout for the left side is 6.7:1. Note that due to rounding, the player has slight advantage using this payout. On this (and any) wager, a house advantage/commission can be applied, for example by multiplying a payout by a reduction factor (e.g. 0.95). A possible payout for the right side can be computed similarly, that is using Table I for the +1 position 205 with a 4/6 RNG we get a probability of 87%. Thus, (1/0.87)−1=0.149, thus the payout can be 0.149:1 or rounded to 0.15:1. This is also equal to 1:6.69 or rounded to 1:6.7.

A player may be allowed to experiment by adjusting the RNG as he or she wishes and viewing differing payouts, until the player is happy with his or her choice. At that point, the player can indicate to game that he or she wishes the game to generate a random number and proceed to the next game state.

Figure 2D:
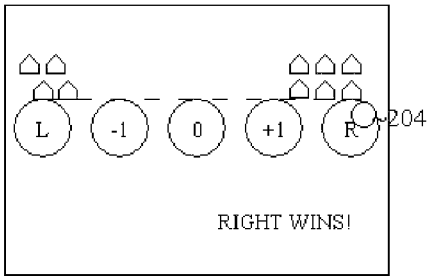
FIG. 2D is an example screen output of a fourth state of a wagering game allowing adjustment of payouts, according to an embodiment.

FIG. 2D is an example screen output of a fourth state of a wagering game allowing adjustment of payouts, according to an embodiment.

The player has proceeded to the next game state, upon which the random number generator (not pictured) has generated a "right" result, thereby putting the piece 204 to the R position 214, ending the game. If the player made any bets on the right side at any of the game states (except the final state upon which the game is over), the player has won a payout offered at a time the wager was made. If the player made any wagers on the left side, he or she has lost those wagers.

FIGS. 2A-2D illustrated how a player can adjust the RNG by adjusting the payouts. In an alternative embodiment, a player can adjust the RNG by spending or receiving money. If the player adjusts the RNG in his or her favor, this can cost the player some cash, while if the player adjusts the RNG in his or her disfavor, this can actually result in some cash to the player. Once a player has already placed a bet, and then the game state is advanced, changing the RNG to favor the side the player has wagered on will help the player's wager (and thus cost him or her). On the other hand, changing the RNG to favor the side opposite to the side the player has wagered on can result in the player being compensated for putting himself or herself at a greater disadvantage.

Figure 3A:
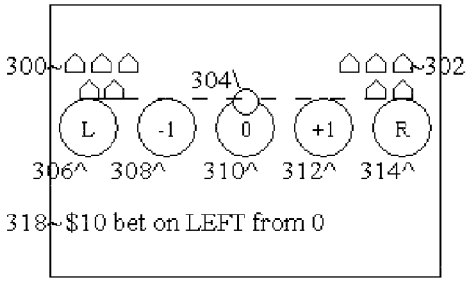
FIG. 3A is an example screen output of a first state of a wagering game offering a player to buy/sell characteristics of the random number generator, according to an embodiment.

FIG. 3A is an example screen output of a first state of a wagering game offering a player to buy/sell characteristics of the random number generator, according to an embodiment.

The game has positions L position 306, −1 position 308, 0 position 310, +1 position 312, and R position 314. The game begins in the initial state, wherein a puck (or piece) 304 is in the 0 position 310. A left weight area 300 displays a magnitude of the left side weight. A right weight area 302 displays a magnitude of the right side weight. An optional rope 305 is illustrated as a dotted line and is used to convey a sense of "tug of war" between the left side and the right side. When the piece 304 reaches the L position 306 or the R position 314 the game has ended and wagers will be paid/taken depending on whether the correct side was chosen or not. A bet indicator 318 indicates the current active bet(s) that the player has made. In this example, the player wagers $10 that the piece 204 will reach the left side.

Not pictured is an output of a player's bankroll and the player's current live wagers.

In the current game state, the RNG is equally weighted for the left side and the right side (e.g. an equal number of weights for each).

The game state is then advanced to the second state by activating the RNG and moving the piece 304 according to the RNG.

Figure 3B:
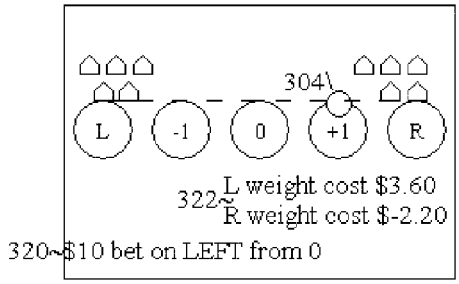
FIG. 3B is an example screen output of a second state of a wagering game offering a player to buy/sell characteristics of the random number generator, according to an embodiment.

FIG. 3B is an example screen output of a second state of a wagering game offering a player to buy/sell characteristics of the random number generator, according to an embodiment.

A weight cost indicator 322 indicates the cost of adding a left weight and a right weight. For example, to add a weight to the left weight area 300 (which in turn can remove a weight from the right weight area 302) will cost the player $3.60. This makes intuitive sense because since the player had wagered on the left side, to weigh the RNG to this side will help the player's bet and thus the player will have to purchase this adjustment (otherwise the house would lose money). If the player wanted to add a weight to the right weight area 302 (which in turn could cause a weight to be removed from the left weight area 300), then this would cost the player −$2.20 (in other words the player would receive $2.20 cash from the game/house). This is intuitive because to weight the RNG to the right would put the player at a disadvantage since the player wanted the piece 304 to reach the left side.

The cost to add weights can be computed as follows. The current value of a $10 wager on left placed at the 0 position 310 when the piece 304 is now in the +1 position 312 is: (the probability of winning*value of a win), which is (from Table I) 24%*$20 (since the player placed a $10 wager which pays 1:1 or results in $20 on a win). Multiplying 0.24*$20=$4.80. Thus, the initial $10 wager the player placed has an expected value of $4.80. Now, if a weight were added to the left side, then we would have a 6/4 RNG and the chance of the piece 304 reaching the left side would be (from Table I) 42%. Thus, the value of the wager with the adjusted RNG would be 0.42*$20=$8.40. Thus, the difference in values ($8.40-$4.80)=$3.60. Thus, it would cost the player $3.60 to add a weight to the left side, thus influencing the outcome in the player's favor. If the player wanted to add a weight to the right side, then the value of the $10 wager with a 4/6 RNG (from Table I) would be 0.13*$20=$2.60. Note that this is less than the current value of this wager ($4.80). $2.60 minus $4.80 equals $2.20. Thus, if the player wanted to add a weight to the right side, the player can receive $2.20 in cash to make this change. Of course, a house advantage can be factored into this transaction so that the cost to the player is actually less than this.

In this example, the player decides to add a weight to the right side (e.g. by clicking the right weight area 202). This brings the game to a third state.

Figure 3C:
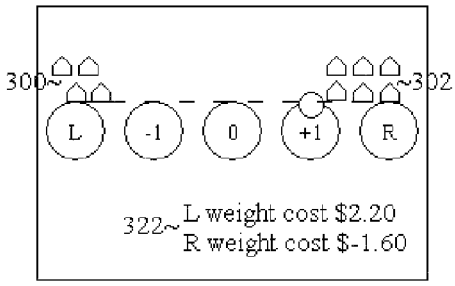
FIG. 3C is an example screen output of a third state of a wagering game offering a player to buy/sell characteristics of the random number generator, according to an embodiment.

FIG. 3C is an example screen output of a third state of a wagering game offering a player to buy/sell characteristics of the random number generator, according to an embodiment.

The player has added a weight to the right side, thus skewing the RNG to favor the right side. The player has received $2.20 cash (which can be added to his bankroll) for this change (the players bankroll is not pictured).

The weight cost indicator indicates that adding a left weight now costs $2.20 and adding a right weight now costs −$1.60. These values can be computed as described previously. The player does not which to make any further changes to the RNG or place any further bets, and thus advances the game to the fourth state (which activates the RNG).

Figure 3D:
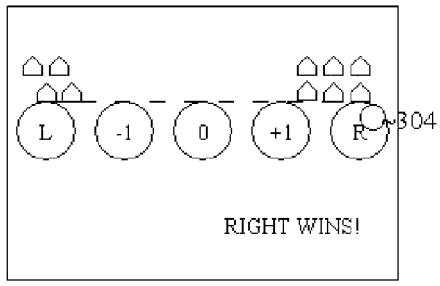
FIG. 3D is an example screen output of a fourth state of a wagering game offering a player to buy/sell characteristics of the random number generator, according to an embodiment.

FIG. 3D is an example screen output of a fourth state of a wagering game offering a player to buy/sell characteristics of the random number generator, according to an embodiment.

The RNG (not pictured) has chosen the right side, and thus the piece 304 has reached the R position 314, wherein the game ends. Since the player had bet on the left side he or she loses his or her wager.

Figure 4:
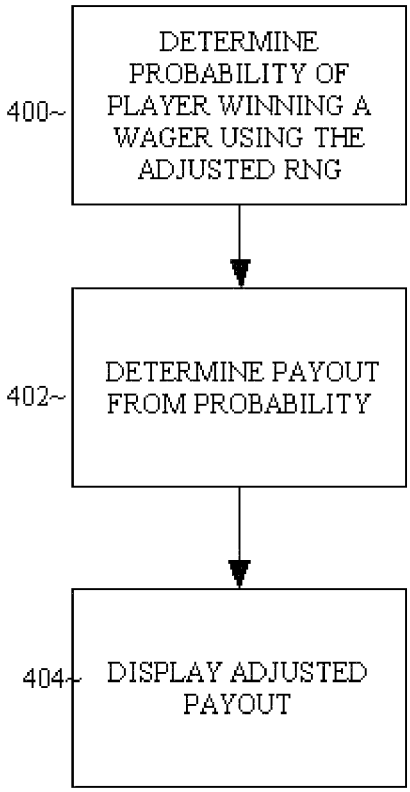
FIG. 4 is a flowchart illustrating an exemplary method of determining payouts for an adjusted random number generator, according to an embodiment.

FIG. 4 is a flowchart illustrating an exemplary method of determining payouts for an adjusted random number generator, according to an embodiment. Note that this method is for a single wager, but if the player has multiple live wagers than this method can simply be applied to all of them. The method in FIG. 4 corresponds to the embodiments illustrated in FIGS. 2A, 2B, 2C, and 2D.

The method can begin with operation 400, which determines a probability of the player winning using an adjusted (or potentially adjusted) RNG. This can be done by generating a table, such as Table I, of all possible outcomes. Such a table can be generated by running a random simulation and tabulating the results, as well known in the art. The probability can also be adjusted by running a real time simulation as well (as opposed to pregenerated).

From operation 400, the method can proceed to operation 402, which determines the payout from the probability determined in operation 400. This can be done as known in the art. Payouts can be displayed in numerous fashions, the standard form for a payout can be A:B (e.g. blackjack pays 3:2, etc.) Payouts can also be determined using a "line" system (e.g. +200, −150, etc.).

From operation 402, the method can proceed to operation 404, wherein the payouts determined in operation 402 can be optionally displayed to the player so the player can decide whether or not he or she wants to proceed with adjusting the RNG.

Figure 5:
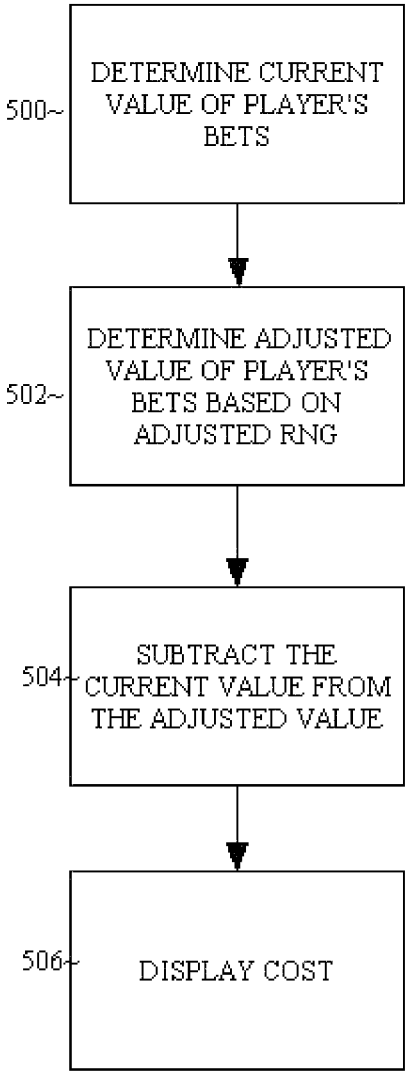
FIG. 5 is a flowchart illustrating an exemplary method of determining purchase prices for an adjusted random number generator, according to an embodiment.

FIG. 5 is a flowchart illustrating an exemplary method of determining purchase prices for an adjusted random number generator, according to an embodiment. Note that this method is for a single wager, but if the player has multiple live wagers than this method can simply be applied to all of them. The method in FIG. 5 corresponds to the embodiments illustrated in FIGS. 3A, 3B, 3C, and 3D.

The method can start with operation 500, which determines a current value of the player's wager(s). This can be done as described herein, such as multiplying the probability of a win by an amount the player receives if there is a win.

From operation 100, the method can proceed to operation 502, which determines an adjusted value of the player's wager(s) based on the adjusted value of the RNG. This can be done as described herein, for example using a table of probabilities to determine the probability of a win and then multiplying the probability by an amount the player receives if there is a win.

From operation 502, the method can proceed to operation 504, which subtracts the current value determined in operation 500 from the adjusted value determined in operation 502. If the value is negative, then this means that the player will be paid money to make the adjustment.

From operation 504, the method can proceed to operational operation 506, wherein the cost is displayed to the player so that the player can make up his or her mind as to whether to go ahead with the adjustment or not.

Embodiments described herein relate to a game with discrete game states. However, continuous games can also be implemented using the descried methods. For example, a game need not pause and wait for player prompting to proceed but can occur in real time. A player has the duty to place his or her bets while the game is occurring or may be able to pause the game while it is occurring in order to place wagers. For example, real time war games can be used wherein events happen successively without a need for player interaction. Further, methods described herein can be applied to any other known game that uses a random number generator to determine outcomes.

It is further noted that described above is a random number generator that operates essentially as a ten sided die, wherein adding a left or right side decreases a number of opposing sides. However, in a further embodiment, the opposing side need not decrease.

Figure 6A:
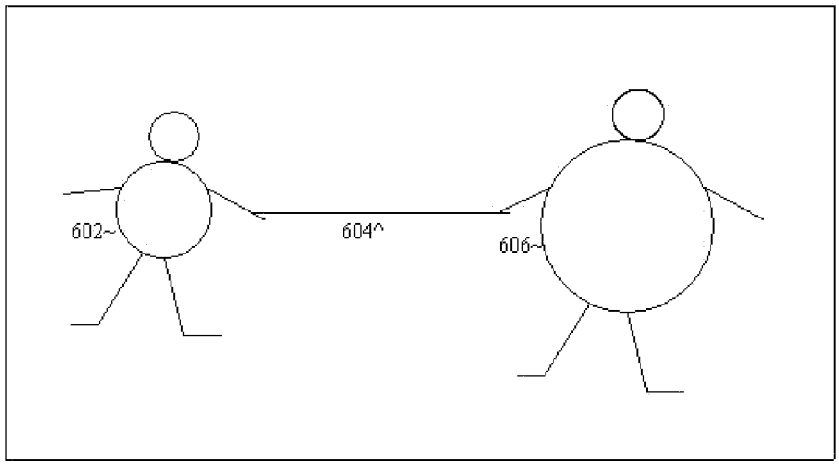
FIG. 6A illustrates an additional analogy related to weighting a random number generator, according to an embodiment.

FIG. 6A illustrates an additional analogy related to weighting a random number generator, according to an embodiment.

A first man 602 is smaller than a second man 606, and both men are tugging a rope 604 between them. The size of a man can be proportional to the weight of the random number generator, e.g., in this example, a RNG is more likely to favor the second man 606. As an alternative to tugging a rope, men can be competing in a variety of fashions such as boxing, wresting, fishing, etc. As the RNG is adjusted, the sizes of either man/woman can be adjusted accordingly. An optionally numerical value can also be displayed (not pictured) quantifying the parameters of the RNG.

Figure 6B:
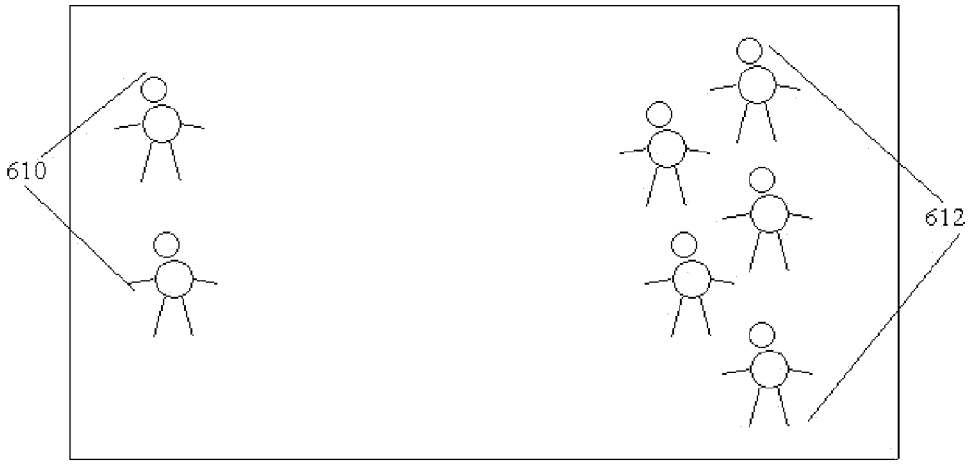
FIG. 6B illustrates a further analogy related to weighting a random number generator, according to an embodiment.

FIG. 6B illustrates a further analogy related to weighting a random number generator, according to an embodiment.

A first group of men 610 is competing with a second group of men 612. Since the second group of men 612 is more numerous than the first group of men 610, a RNG would typically (although it could work in the reverse direction as well) prefer the second group of men 612. Thus a moving piece would be more likely to reach the second group of men 612, or the second group of men 612 would be more likely to win a war or a fight, or any contest between both groups would prefer the second group. As the RNG is adjusted, men can be added/taken away from each side.

For example, both groups of men can fight and a player can wager on which side will win. If the player wants to add a soldier to a side the player has a wager on, then the player would either receive an adjusted payout or would pay a computed cost for this ability.

It is noted that any of the operations described herein can be performed in any sensible order. Further, any operations may be optional. Also, any feature or embodiment described herein (including any document incorporated by reference) can be combined with any other feature described herein (including any document incorporated by reference).

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to play a wagering game using a player, the method comprising:

executing the following operations on a processor running on a computer to play a game, the game having more than two possible game states:

receiving a wager from a player in a first game state;

computing a cost to the player to use an adjusted random number generator;

offering to the player an option to adjust the random number generator in exchange for receiving the cost from the player;

upon receiving acceptance by the player to exercise the adjusted random number generator, adjusting the random number generator which affects determinations of subsequent game states and deducting the cost from the player;

continuing the game from the first game state to additional game states and completing the game; and resolving the wager, wherein if the adjusted random number generator disfavors the wager, then the cost is negative and a player's bankroll will be increased by the absolute value of the cost.

2. The method as recited in claim 1, wherein acceptance of the option is received from the player to adjust the random number generator, the random number generator is adjusted, and the cost is deducted from the player.

3. The method as recited in claim 1, wherein the adjusted random number generator is used to determine a direction a piece will move.

4. The method as recited in claim 1, wherein the adjusted random number generator is weighted to prefer a particular direction.

5. The method as recited in claim 1, wherein the adjusted random number generator is illustrated using weights.

6. A method to play a wagering game using a player, the method comprising:

executing the following operations on a processor running on a computer to play a game:

receiving a wager from a player in a first game state;

determining an adjusted random number generator;

computing a cost to the player to use the adjusted random number generator;

offering to the player an option to adjust the random number generator in exchange for paying the cost from the player, and upon acceptance by the player, adjusting the random number generator for the cost which affects determinations of subsequent game states; and continuing the game from the first game state, wherein the adjusted random number generator disfavors the wager, the cost is negative and a player's bankroll is increased by the absolute value of the cost.

7. The method as recited in claim 6, wherein the acceptance is received from the player after the offering.

8. The method as recited in claim 6, wherein the adjusted random number generator is used to determine a direction a piece will move.

9. The method as recited in claim 6 wherein the adjusted random number generator is weighted to prefer a particular direction.

10. The method as recited in claim 6, wherein the adjusted random number generator is illustrated using weights.

11. An apparatus to play a wagering game using a player, the apparatus comprising:

an output device;

a computer connected to the output device and configured to play a game having more than two possible game states and to:

receive a wager from a player in a first game state;

compute a cost to the player to use an adjusted random number generator;

offer to the player an option to adjust the random number generator in exchange for receiving the cost from the player, the adjusted random number generator favoring the player;

if not received from the player to exercise the option, then continue the game without adjusting the random number generator to completion, resolve the wager, and end the game;

if received from the player to exercise the option, then:

(a) adjust the random number generator which affects determinations of subsequent game states and deducting the cost from the player;

(b) continuing the game from the first game state to additional game states and completing the game; and (c) resolve the wager wherein if the adjusted random number generator disfavors the wager, then the cost is negative and a player's bankroll is increased by the absolute value of the cost.

12. The apparatus as recited in claim 11, wherein the adjusted random number generator is used to determine a direction a piece will move.

13. The apparatus as recited in claim 11, wherein the adjusted random number generator is weighted to prefer a particular direction.

14. The apparatus as recited in claim 11, wherein the adjusted random number generator is illustrated using weights.

* * * * *